US008727507B2

(12) United States Patent
Fukada et al.

(10) Patent No.: US 8,727,507 B2
(45) Date of Patent: May 20, 2014

(54) INK-JET APPARATUS

(75) Inventors: Kazuki Fukada, Osaka (JP); Hiroshi Hayata, Osaka (JP); Hidehiro Yoshida, Osaka (JP)

(73) Assignee: Panasonic Corporation, Osaka (JP)

( * ) Notice: Subject to any disclaimer, the term of this patent is extended or adjusted under 35 U.S.C. 154(b) by 114 days.

(21) Appl. No.: 13/449,364

(22) Filed: Apr. 18, 2012

(65) Prior Publication Data

US 2012/0268523 A1 Oct. 25, 2012

(30) Foreign Application Priority Data

Apr. 20, 2011 (JP) ..... 2011-093748
Mar. 8, 2012 (JP) ..... 2012-051999

(51) Int. Cl.
*B41J 2/045* (2006.01)

(52) U.S. Cl.
USPC ..... 347/70; 347/68; 347/69; 347/71; 347/72

(58) Field of Classification Search
USPC ..... 347/68–72
See application file for complete search history.

(56) References Cited

U.S. PATENT DOCUMENTS

| | | | | |
|---|---|---|---|---|
| 5,818,482 | A | 10/1998 | Ohta et al. | |
| 6,053,601 | A | 4/2000 | Watanabe et al. | |
| 6,176,570 | B1 | 1/2001 | Kishima et al. | |
| 2002/0180844 | A1 * | 12/2002 | Takahagi et al. | 347/70 |
| 2005/0195228 | A1 | 9/2005 | Mita et al. | |

FOREIGN PATENT DOCUMENTS

| | | |
|---|---|---|
| JP | 7-52381 | 2/1995 |
| JP | 8-164607 | 6/1996 |
| JP | 9-39234 | 2/1997 |
| JP | 11-115181 | 4/1999 |
| JP | 2005-280439 | 10/2005 |
| JP | 2010-214851 | 9/2010 |

* cited by examiner

*Primary Examiner* — Justin Seo
(74) *Attorney, Agent, or Firm* — Panasonic Patent Center

(57) ABSTRACT

Provided is an ink-jet apparatus that: has a wide control range of the direction for ink ejection; can correct a variation in the direction for ink ejection; and can improve the yield of a product when used for manufacture of electronic devices. The ink-jet apparatus includes: pressure chamber 110 configured with a pair of partition walls 111; nozzle plate 101 having nozzle 100; diaphragm 112 supported by partition walls 111; piezoelectric elements 131 and 132 that are in contact with diaphragm 112 for pressurizing pressure chamber 110; and piezoelectric elements 141, 142 and 143 supporting partition walls 111. A voltage can be applied individually to piezoelectric elements 131, 132, and 141 to 143. The widths of part A and part B of diaphragm 112, part A being in contact with a piezoelectric element, and part B being in contact with partition wall 111 satisfy a particular relationship.

6 Claims, 11 Drawing Sheets

INK-JET APPARATUS

CROSS REFERENCE TO RELATED APPLICATIONS

This application is entitled and claims the benefit of Japanese Patent Application No. 2011-093748, filed on Apr. 20, 2011, and of Japanese Patent Application No. 2012-051999, filed on Mar. 8, 2012, the disclosure of which including the specification, drawings and abstract is incorporated herein by reference in its entirety.

TECHNICAL FIELD

The present invention relates to an ink-jet apparatus.

BACKGROUND ART

In recent years, a method of manufacturing electronic devices using ink-jetting techniques has been calling attention.

Compared to vapor deposition or other process, ink-jetting facilitates inexpensive manufacture using equipment with a simple structure. Further, because ink-jetting is a direct patterning technique, masks are not required unlike in vapor deposition and thus manufacture of larger products is possible. For example, as demands of the market for larger displays in electronic display devices have increased, expectations for a technique for manufacturing electronic devices by ink-jet coating have also increased.

A manufacturing technique by coating will be described below using an organic EL display panel as an example.

FIG. 1 shows a structure of an organic EL display panel. The organic EL display panel includes substrate 1, cathodes 32, light emitting layers 301R, 301G and 301B, anodes 33, and partition walls (hereinafter also referred to as "banks") 31. Substrate 1 includes TFTs (not shown) for driving the display inside. Further, a seal film, a color filter, or the like (not shown) are appropriately arranged over cathode 32.

The organic EL display panel includes three types of light emitting layers corresponding to three colors: red (R), green (G) and blue (B). The three-color light emitting layers are represented by 301R, 301G and 301B. Banks 31 are used for the patterning of ink to be applied to each pixel, in ink-jet coating that will be described in the following section of a manufacturing process. Ink refers to a solution containing a material of a light emitting layer dissolved in solvent.

Examples of the raw material of the light emitting layer of the organic EL display panel include polymeric materials such as polyfluorenes, polyarylenes, polyarylenevinylenes, alkoxybenzene and alkylbenzene, and examples of the solvent include toluene, xylene, acetone, anisole, methyl ethyl ketone, methyl isobutyl ketone, cyclohexylbenzene and mixed solvent thereof.

Because bank 31 is formed to define a region in which ink is to be applied, ink that has been applied remains in the desired pixel region. By this means, a high-quality display can be manufactured without causing mixing of inks among pixel regions. A fluorine-containing resin is used as a material of bank 31. Bank 31 is ink repellent.

The device thus configured emits a light when electrons from the cathode and holes from the anode are combined in the light emitting layer, consequently performing a function as a display.

FIG. 2 shows a cross-section of the organic EL display panel cut at the height of the light emitting layer. FIG. 2 shows an example in which three colors of R, G and B are patterned in the form of pixel. By making each of the pixels emit a light, the organic EL display panel can function as a display apparatus for a TV or the like. A region in which the pixels are formed is called a display region.

The width of the pixel and the pixel pitch is 50 to 100 μm. Because the width of the pixel and pixel-to-pixel distance are extremely small, precise coating techniques such as ink jetting is required.

Next, a process of manufacturing the organic EL display panel will be described.

First, an anode is arranged on the substrate by photolithography.

Next, a bank is made by photolithography. Afterward, inks of R, G and B for the light emitting layer are applied on the substrate by ink-jet printing. The applied inks are dried in the coating step and the subsequent step and a pattern of the light emitting layer is formed. Afterward, a cathode is formed on the light emitting layer by sputtering or the like.

The application of ink by ink-jetting will be described below.

FIGS. 3A and 3B show an overview of an ink-jet apparatus (or droplet ejection apparatus). FIG. 3A shows a state before coating regions are formed on substrate 1 by the ink-jet apparatus. FIG. 3B shows a state after coating regions are formed on substrate 1 by the ink-jet apparatus.

As shown in FIGS. 3A and 3B, the ink-jet apparatus includes mount 41, substrate transfer stage 42 disposed on mount 41, and ink-jet head 50 facing substrate transfer stage 42. Ink-jet head 50 is mounted on gantry 43 disposed across substrate transfer stage 42. Regarding the size of substrate 1, a substrate made of the eighth generation glass is around 2 m×2.5 m.

FIGS. 4A and 4B show a structure of the ink-jet head. FIG. 4A shows a cross-sectional view of the ink-jet head when a pressure is not applied to pressure chamber 110. FIG. 4B shows a cross-sectional view of the ink-jet head when a pressure has been applied to pressure chamber 110.

The ink-jet head includes multiple nozzles 100 for ejecting ink, pressure chambers 110 that communicate with nozzles 100, partition walls 111 that separate pressure chambers 110, diaphragm 112 that constitutes part of pressure chambers 110, piezoelectric elements 130 that vibrate diaphragm 112, piezoelectric elements 140 that support partition walls 111, common electrodes 120 and individual electrodes 121 for applying a voltage to piezoelectric elements 130, and drive circuit 122 to which common electrodes 120 and individual electrodes 121 are connected. The ink-jet head further includes an ink feed port (not shown).

Further, when being configured to circulate ink, the ink-jet head further includes an ink discharge port (not shown). Piezoelectric element 130 and piezoelectric element 140 are formed by cutting a plate of the piezoelectric element material by dicing. Nozzle 100 has a diameter of 20 to 50 μm, and the pitch of nozzle 100 is 100 to 500 μm. The number of nozzles 100 in each row is 100 to 300.

The ink-jet head thus configured operates as follows. When a voltage is applied between common electrode 120 and individual electrode 121, piezoelectric element 130 is deformed from the state shown in FIG. 4A to the state shown in FIG. 4B. When piezoelectric element 130 is deformed, the volume of pressure chamber 110 decreases to apply a pressure to ink. By the pressure, ink is ejected from nozzle 100.

Next, the coating operation of the ink-jet apparatus will be described.

Substrate transfer stage 42 is moved from the state shown in FIG. 3A to the state shown in FIG. 3B. At this time, ink is discharged from ink-jet head 50 toward substrate 1 disposed on substrate transfer stage 42 to apply ink to region 44 on substrate 1 to which ink needs to be applied. The speed at which substrate transfer stage 42 is transferred is 20 to 400 mm/s. The ejection frequency is 1,000 to 5,000 Hz. The ink-jet apparatus forms a pixel pattern by detecting the position of substrate transfer stage 42 and controlling the timing of ink ejection.

In order to form the pixel pattern, it is necessary to reduce the variation in angle at which droplets to be ejected from nozzle 100 is ejected. The maximum allowable value of the variation in ink ejection angle is generally 10 to 50 mrad. A phenomenon in which ink droplets are not ejected straightly from nozzle 100 is generally called "curved flying of ink droplets." Due to factors such as the accuracy of manufacturing nozzle 100, degradation of liquid-repellent coating of nozzle 100, a remaining ink material after wipe, a variation in ink ejection angle may occur between the early stage and the middle stage when manufacturing a product by a coating method.

A technique for correcting the variation is disclosed in Patent Literature 1, in which piezoelectric elements are provided around nozzles to control the direction for ink ejection. FIG. 5 shows an ink-jet head according to Patent Literature 1. Reference sign 13 denotes a nozzle. Ink is ejected by applying a voltage to piezoelectric element 22 by electrodes 21 and 23 to deform piezoelectric element 22 and vibration plate 18. At the same time, the direction for ink ejection is controlled by deforming thin plate material 16 arranged at the outlet of nozzle 13 by piezoelectric element 22.

Further, an ink-jet apparatus having partition walls that separate pressure chambers, piezoelectric element A for applying a pressure to a pressure chamber via a diaphragm, and piezoelectric element B that is in contact with each partition wall via the diaphragm, is known (for example, see Patent Literatures 2 to 7). Among such apparatus, an ink-jet apparatus is known in which an electrical circuit is connected to both of piezoelectric element A and piezoelectric element B, and when piezoelectric element A is extended toward a pressure chamber, piezoelectric element B is extended or contracted with respect to a pair of partition walls that form this pressure chamber (for example, see Patent Literatures 4 and 5). Alternatively, an ink-jet apparatus is known in which: the width of a part of piezoelectric element A, the part being in contact with the diaphragm in the direction in which nozzles are lined; the width of a part of piezoelectric element B, the part being in contact with the diaphragm; and the width of a part of the partition wall, the part being in contact with the diaphragm; are smaller than the widths of piezoelectric element A, piezoelectric element B, and the partition wall, respectively, and the relationships among the above widths are defined (for example, see Patent Literatures 6 and 7).

In addition to the above apparatus, the following ink-jet apparatus are known: an ink-jet apparatus having partition walls, piezoelectric elements A, and a diaphragm, the partition walls being a laminate of multiple layers having different stiffness (for example, see Patent Literatures 8 and 9); and an ink-jet apparatus having piezoelectric element A and partition walls integrally formed with the ceiling of a pressure chamber, in which extended piezoelectric element A presses the ceiling to deform the partition walls so as to apply a pressure to ink in the pressure chamber (for example, see Patent Literature 10).

CITATION LIST

Patent Literature

PTL 1
Japanese Patent Application Laid-Open No. 2010-214851
PTL 2
Japanese Patent Application Laid-Open No. 9-39234
PTL 3
U.S. Pat. No. 6,176,570
PTL 4
Japanese Patent Application Laid-Open No. 11-115181
PTL 5
U.S. Pat. No. 6,053,601
PTL 6
Japanese Patent Application Laid-Open No. 8-164607
PTL 7
U.S. Pat. No. 5,818,482
PTL 8
Japanese Patent Application Laid-Open No. 2005-280439
PTL 9
U.S. Patent Application Publication No. 2005/0195228
PTL 10
Japanese Patent Application Laid-Open No. 7-52381

SUMMARY OF INVENTION

Technical Problem

In future, as a high-definition organic EL display panel is developed, it becomes more important to control the direction for ink ejection and reduce the variation in ink ejection angle. Examples of the cause of the variation in ink ejection include the accuracy of manufacturing nozzles, degradation of liquid-repellent coating of nozzles, and a remaining ink material after wipe.

Ink-jet head of FIG. 5 changes the direction of each nozzle by thin plate material 16. Therefore, there is a problem that the direction for ink ejection cannot be sufficiently controlled. When the direction for ink ejection cannot be sufficiently controlled, it is not possible to correct the variation in ink ejection angle. For this reason, large-scale maintenance of an ink-jet apparatus is required, lowering the operating ratio of the apparatus. Further, when an organic EL display panel is manufactured using an ink-jet apparatus in which the variation in ink ejection angle is not sufficiently reduced, defects such as mixing of colors occurs during manufacture, thus lowering the yield of the product.

Improvements have been expected for other ink-jet apparatus, in the way how piezoelectric elements, a diaphragm, and partition walls are arranged so as to arrange the diaphragm to deform the diaphragm into a desired shape when the ink-jet apparatus is assembled.

The present invention has been made to overcome the above problems arisen with the conventional apparatus, and the present invention provides an ink-jet apparatus that reduces the variation in the direction for ink ejection and that preferably has wide control range of the direction for ink ejection. It is an object of the present invention to provide an ink-jet apparatus that can improve the yield of the product by virtue of the above features when used for manufacture of electronic devices.

Solution to Problem

In order to accomplish the above purpose, the present invention provides an ink-jet apparatus given below.

[1] An ink-jet apparatus includes multiple nozzles for ejecting ink; pressure chambers, each of the pressure chambers communicating with each of the nozzles; piezoelectric elements A for applying a pressure to the pressure chambers; partition walls arranged between the pressure chambers; piezoelectric elements B, each of piezoelectric elements B supporting each of the partition walls; and a diaphragm arranged between the partition walls and the piezoelectric elements B, the diaphragm being in contact with the piezoelectric elements A. Here, a relationship L4≥L2≥L1 is satisfied when: L1 is a width of a part of each of the piezoelectric elements A in direction X along which the nozzles are arranged, the part being in contact with the diaphragm; L2 is a width of a part of each of the piezoelectric elements B in direction X, the part being in contact with the diaphragm; and L4 is a width of a part of each of the piezoelectric elements A and the piezoelectric elements B in direction X. And also, a relationship W2>W1 is satisfied when: W1 is a width of a part of each of the piezoelectric elements A and the piezoelectric elements B in direction Y perpendicular to direction X and along an axis of each of the nozzles; and W2 is a width of a part of each of the piezoelectric elements A or each of the piezoelectric elements B in direction Y, the part being in contact with the diaphragm.

[2] The ink-jet apparatus according to [1], further including: an ink supply channel configured to allow ink to be supplied to the pressure chambers to flow therein and an ink discharge channel configured to allow ink discharged from the pressure chambers to flow therein, the ink supply channel and the ink discharge channel being arranged at the piezoelectric element side with respect to the diaphragm; ink inlet channels configured to allow the ink supply channel to communicate with the pressure chambers via through holes X formed in the diaphragm, the ink inlet channels being arranged at a partition wall side with respect to the diaphragm; and ink outlet channels configured to allow each of the pressure chambers to communicate with the ink discharge channel via through holes Y formed in the diaphragm, the ink outlet channels being arranged at the partition wall side with respect to the diaphragm.

[3] The ink-jet apparatus according to [1] or [2], wherein a relationship L2>L3 is satisfied when L3 is a width in direction X of a part of each of the partition walls, the part being in contact with the diaphragm.

[4] The ink-jet apparatus according to any one of [1] to [3], wherein each of through holes X is a mesh in the diaphragm.

[5] The ink-jet apparatus according to any one of [1] to [4], wherein compressive stiffness of the partition walls is lower than compressive stiffness of other walls of each of the pressure chambers.

[6] The ink-jet apparatus according to any one of [1] to [5], wherein at least two of the partition walls are arranged between the pressure chambers, and at least two of the piezoelectric elements B respectively support each of the partition walls.

Advantageous Effects of Invention

The present invention can reduce defects of ink ejection caused by displacement of relative positions of: a diaphragm to piezoelectric element A; the diaphragm to piezoelectric element B; and the diaphragm to partition walls. More preferably, according to the present invention, the shape of the pressure chamber can be deformed, making it possible to change the direction in which a pressure is applied. By this means, the control range of the direction for ink ejection can be widened. Consequently, the variation in the direction for ink ejection can be reliably corrected.

As described above, the present invention can provide an ink-jet apparatus that can correct the variation in the direction for ink ejection, and more preferably an ink-jet apparatus having a wide control range of the direction for ink ejection. Further, the present invention can provide an ink-jet apparatus that can improve the yield of the product when used for manufacture of electronic devices.

DESCRIPTION OF EMBODIMENTS

Embodiments of the present invention will be described in detail with reference to the accompanying drawings.

Embodiment 1

Figure 6:
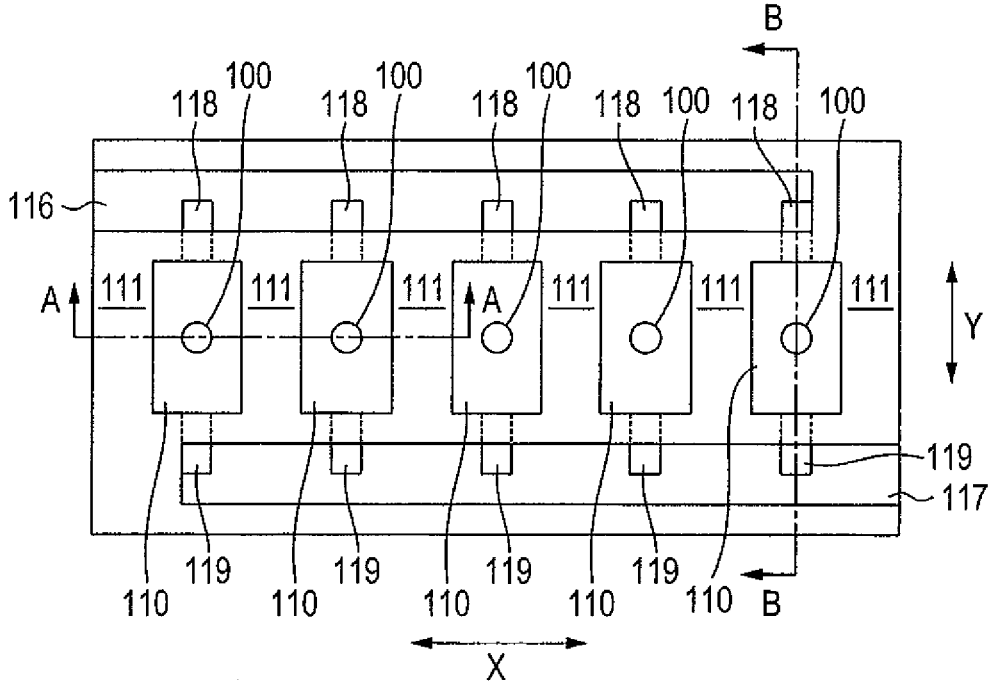
FIG. 6 is a schematic drawing of a structure of an ink-jet head according to Embodiment 1 of the present invention.

FIG. 6 schematically shows a structure of an ink-jet head included in an ink-jet apparatus according to Embodiment 1 of the present invention when the ink-jet head is seen along the axial direction of a nozzle. The ink-jet head of FIG. 6 include ink supply channel 116 and ink discharge channel 117 arranged along direction X, multiple pressure chambers 110 arranged between ink supply channel 116 and ink discharge channel 117 in direction Y, nozzle 100 that allows pressure chamber 110 to communicate with outside, partition walls 111 that separate each of pressure chambers 110, ink inlet channel 118 that allows pressure chamber 110 to communicate with ink supply channel 116, and ink outlet channel 119 that allows pressure chamber 110 to communicate with ink discharge channel 117. Direction X is a direction in which nozzles 100 are arranged, and shows direction of the length of the ink-jet head. Direction Y is a direction perpendicular to direction X and the axis of nozzle 100, and shows the direction of the width of the ink-jet head.

Figure 7A:
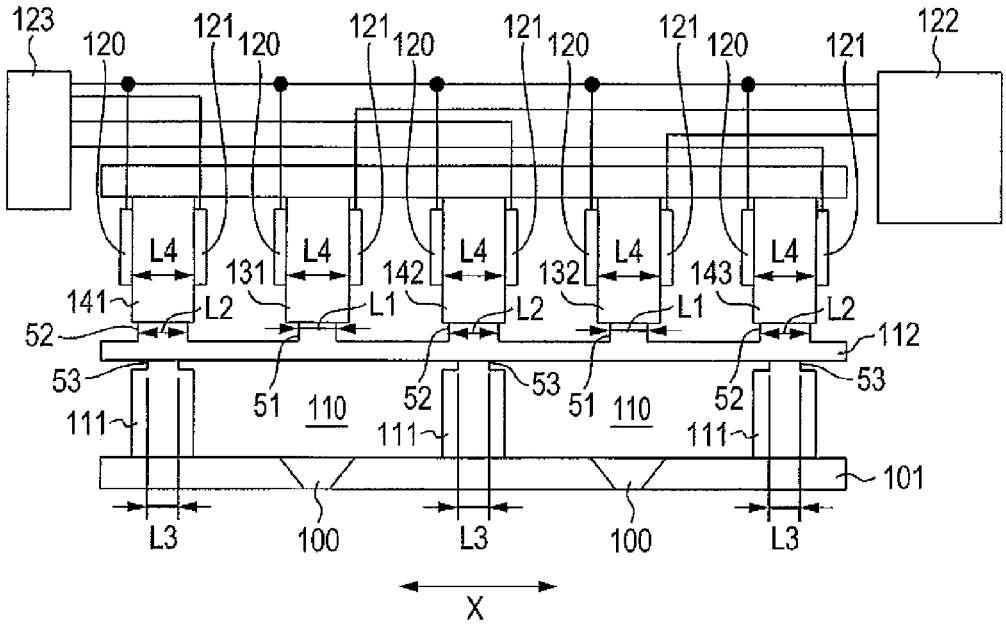
FIGS. 7A and 7B are a cross-sectional view of the ink-jet head of FIG. 6.
Figure 7B:
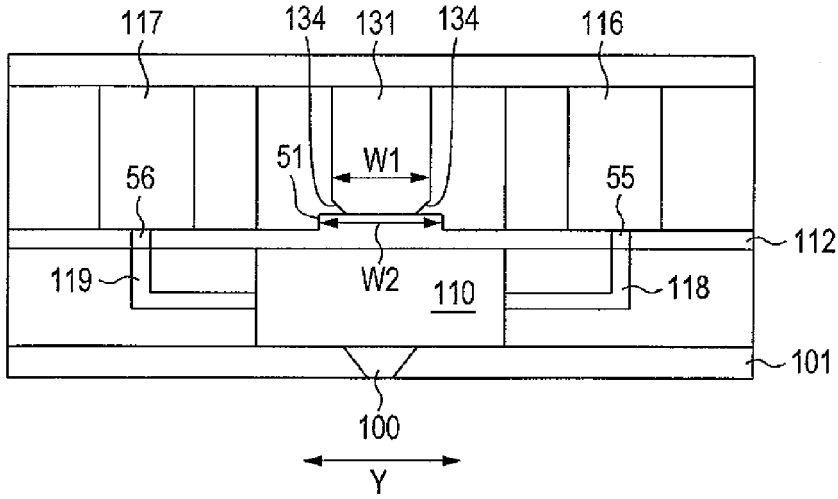

FIG. 7A is a cross-sectional view of the ink-jet head of FIG. 6, taken along with line A-A in FIG. 6. FIG. 7B is a cross-sectional view of the ink-jet head of FIG. 6, taken along with line B-B in FIG. 6. As shown in FIG. 7A, pressure chamber 110 includes nozzle plate 101 having nozzles 100, partition walls 111 extending upright from nozzle plate 101, and diaphragm 112 attached to the upper surface of each partition wall 111. Piezoelectric element 131 or 132 is arranged on each of pressure chambers 110 via diaphragm 112, and piezoelectric element 141, 142 or 143 is arranged on each of partition walls 111 via diaphragm 112. Piezoelectric elements 131 and 132 correspond to piezoelectric element A for applying a pressure to the pressure chamber. Piezoelectric elements 141, 142 and 143 correspond to piezoelectric element B supporting the partition wall.

In the ink-jet head shown in FIG. 6 and FIGS. 7A and 7B, the size of each component is not in particular limited. For example, nozzle 100 may have a diameter of 20 to 50 μm, the pitch of nozzle 100 may be 100 to 500 μm, and the number of nozzles 100 in each row may be 100 to 300. Further, nozzle plate 101 has a thickness of 30 to 100 μm, pressure chamber 110 has a width of 50 to 200 μm, partition wall 111 has a width of 50 to 100 μm, and diaphragm 112 has a thickness of 5 to 20 μm. The piezoelectric elements have a width of 50 to 100 μm and a height of 500 to 1,000 μm.

As shown in FIG. 7A, piezoelectric elements 131 and 132 have common electrode 120 attached. Further, piezoelectric elements 141, 142 and 143 may have common electrode 120 attached. Each of common electrodes 120 is connected to direction control circuit 123.

Piezoelectric elements 131 and 132 have individual electrode 121 attached. Further, piezoelectric elements 141, 142 and 143 may have individual electrode 121 attached. Each of individual electrodes 121 is connected to drive circuit 122.

Hereinafter, piezoelectric elements 131 and 132, and piezoelectric elements 141, 142 and 143 are collectively referred to as "piezoelectric element(s)."

As shown in FIG. 7A, diaphragm 112 includes multiple convex portions 51 each of which is in contact with each tip of the piezoelectric elements, and multiple convex portions 52 each of which is in contact with each tip of the piezoelectric elements. Diaphragm 112 is, for example, a thin plate made of an alloy of nickel and cobalt. Convex portions 51 and 52 are both formed by plating.

Convex portion 51 is in contact with the center in direction X of the end surface of piezoelectric element 131 or 132. Convex portion 52 is in contact with the center in direction X of the end surface of piezoelectric element 141, 142 or 143. The distance between the center in direction X of convex portion 51 and the center in direction X of convex portion 52 is the same as the center-to-center distance between mutually adjacent piezoelectric elements.

Width L1 of a part of convex portion 51, the part being in contact with piezoelectric element 131 or 132, is 40 to 55 μm, for example. Width L2 of a part of convex portion 52, the part being in contact with piezoelectric element 141, 142 or 143, is 50 to 65 μm, for example.

Partition wall 111 includes convex portion 53 that is in contact with the bottom surface of diaphragm 112. Partition wall 111 is, for example, a laminate of thin plates made of stainless steel. Convex portion 53 is arranged in the center in direction X of the end surface of partition wall 111. A material of convex portion 53 is metal that is joined to partition wall 111 (for example, a material of partition wall 111), and convex portion 53 is formed by thermal diffusion bonding. Width L3 of a part of convex portion 53, the part being in contact with diaphragm 112, is 40 to 60 μm, for example.

L4 is a width in direction X of each of the piezoelectric elements. Each L4s is the same and may be 50 to 200 μm, with the example being 60 to 80 μm. The piezoelectric element is formed by equidistantly cutting a plate of a material of the piezoelectric element by dicing.

In the present embodiment 1, widths L1 to L4 satisfy the relationship L4≥L2>L1, and more preferably, satisfies the relationship L2>L3.

The difference between L1 and L2 is preferably 10 to 20 μm. The difference between L1 and L4 is preferably 10 to 30 μm. The difference between L2 and L3 is preferably 10 to 30 μm. The difference between L2 and L4 is preferably 10 to 30 μm.

In this way, L4 is greater than L1. Therefore, even when displacement of relative positions of diaphragm 112 to the piezoelectric element occurs in direction X upon positioning, piezoelectric elements 131 and 132 are reliably in contact with convex portions 51. Therefore, diaphragm 112 can be pressed reliably by piezoelectric elements 131 and 132 at the center in direction X of pressure chamber 110.

Further, L4 is equal to or greater than L2. Therefore, even when displacement of relative positions of diaphragm 112 to piezoelectric element occurs in direction X upon positioning, piezoelectric elements 141, 142 and 143 are reliably in contact with convex portions 52. Therefore, partition wall 111*s* can be pressed by piezoelectric elements 141, 142 and 143 via convex portions 53.

Further, L1 is smaller than L2. For this reason, compared to convex portion 52, convex portion 51 is hard to protrude in direction X outwardly off the piezoelectric element.

Figure 8:
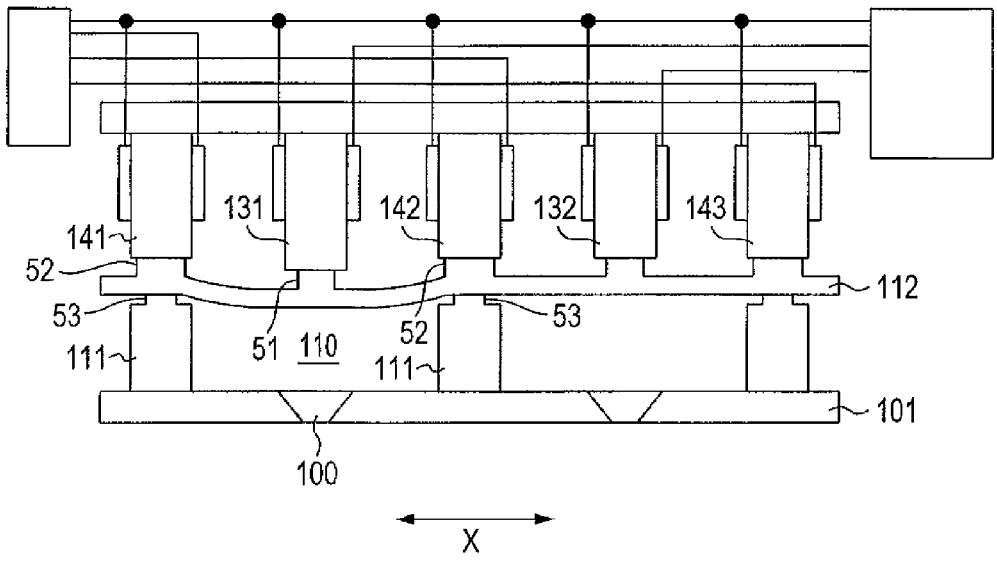
FIG. 8 shows a shape of diaphragm 112 during ink ejection.

Further, L2, that is a width of convex portion 52, is preferably greater than L3, that is a width of convex portion 53. By this means, convex portion 53 is hard to protrude in direction X outwardly off convex portion 52. In the case where convex portion 53 does not protrude in direction X outwardly off convex portion 52 toward the pressure chamber 110 side, diaphragm 112 is deformed from the edge of convex portion 52 when piezoelectric elements 131 and 132 are extended (see FIG. 8). Therefore, when convex portion 53 does not protrude in direction X outwardly off convex portion 52, convex portion 53 will not adversely affect the shape of diaphragm 112 when diaphragm 112 is being deformed. Accordingly, a pressure can be applied stably to pressure chamber 110.

As shown in FIG. 7(B), ink supply channel 116 and ink discharge channel 117 are arranged at the piezoelectric element 131 side with respect to diaphragm 112. Ink inlet channel 118 and ink outlet channel 119 are arranged at the pressure chamber 110 side with respect to diaphragm 112. Ink supply channel 116 communicates with ink inlet channel 118 via hole 55 that is provided in diaphragm 112. Ink discharge channel 117 communicates with ink outlet channel 119 via hole 56 provided on diaphragm 112. Holes 55 and 56 correspond to through holes X and Y, respectively.

Each width W1 in direction Y of the piezoelectric element is the same, with the example being 40 to 80 μm. Further, width W2 in direction Y of part in which convex portion 51 is in contact with each of the piezoelectric elements is the same, with the example being 50 to 200 μm. Further, as shown in FIG. 7B, tapered surface 134 is formed at the opposite end edges in direction Y of the piezoelectric element. The size of tapered surface 134 is 0.1 to 0.2 μm, for example.

In the present Embodiment 1, W1 and W2 satisfy the relationship W2>W1. The difference between W1 and W2 is preferably 20 to 100 μm.

Figure 9:
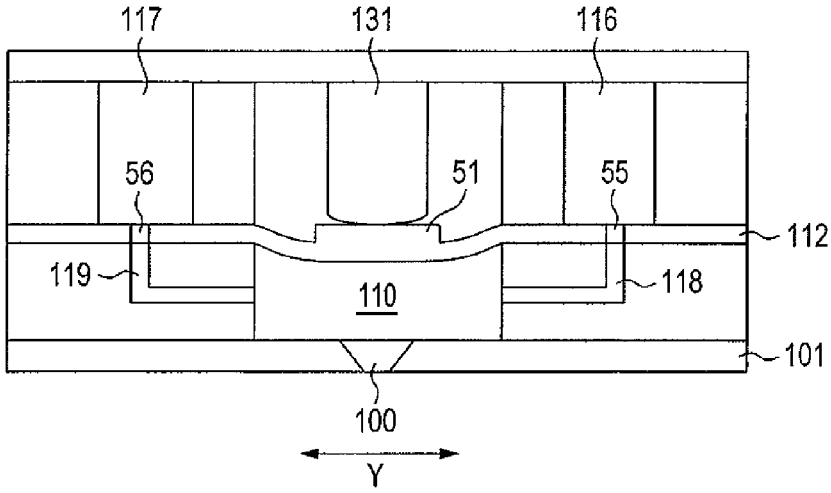
FIG. 9 shows a shape of a piezoelectric element and a shape of diaphragm 112 during ink ejection.

In this way, width W1 in direction Y of the piezoelectric element is smaller than width W2 in direction Y of convex portion 51. For this reason, the piezoelectric element is hard to protrude in direction Y outwardly off convex portion 51. As shown in FIG. 9, when being extended, the piezoelectric element is deformed so that its center part in direction Y protrudes maximally. For this reason, when the piezoelectric element does not protrude in direction Y outwardly off convex portion 51, the movement with the largest maximum change in the length of the piezoelectric element when the piezoelectric element is extended is reliably transmitted to diaphragm 112. Accordingly, diaphragm 112 on pressure chamber 110 and partition wall 111 can be pressed stably.

In the present embodiment, ink in ink supply channel 116 is supplied through hole 55 and ink inlet channel 118 to pressure chamber 110 by a negative pressure in pressure chamber 110 that is generated, for example, when piezoelectric elements 131 and 132 are contracted after they are extended. Part of the ink supplied to pressure chamber 110 is ejected from nozzle 100 by applying a pressure to pressure chamber 110 by extension of piezoelectric elements 131 and 132, and the remaining ink is discharged through ink outlet channel 119 and hole 56 into ink discharge channel 117. The ink that has been discharged into ink discharge channel 117 is supplied to ink supply channel 116, and will be used again as ink.

According to the present embodiment, because W1 is smaller than W2, ink supply channel 116 and ink discharge channel 117 can be arranged at the piezoelectric element side with respect to diaphragm 112. Because the volume of the ink-jet head at the piezoelectric element side with respect to diaphragm 112 is generally greater than the volume of the ink-jet head at the pressure chamber side with respect to diaphragm 112, it is possible to increase the volume of ink supply channel 116 and the volume of ink discharge channel 117. Therefore, the circulation volume of ink can be increased.

Further, when hole 55 has a mesh shape, it is possible to prevent foreign particles in ink from intruding into pressure chamber 110. Hole 55 having a mesh shape can be formed by arranging a mesh at the opening of hole 55. Alternatively, by providing multiple smaller holes to configure hole 55, hole 55 having a mesh shape can be formed.

Figure 10A:
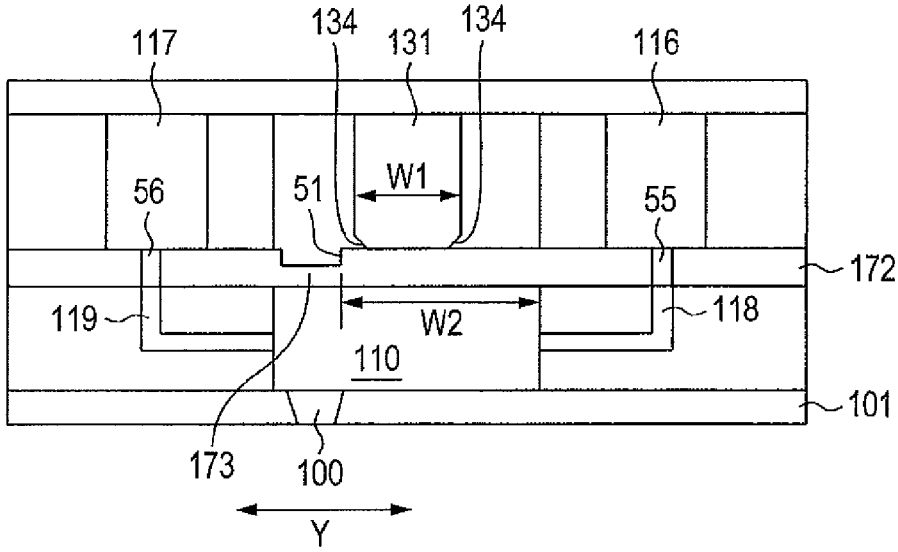
FIGS. 10A and 10B show a modification according to Embodiment 1.

Further, in the present embodiment, as shown in FIG. 10A, diaphragm 172 can be used for diaphragm 112. Diaphragm 172 includes thin part 173 at ink outlet channel 119 side of pressure chamber 110 in direction Y. Nozzle 100 is formed in the position opposite to thin part 173. Such a configuration is effective to smoothly eject ink from nozzle 100 and smoothly discharge ink into ink outlet channel 119.

Figure 10B:
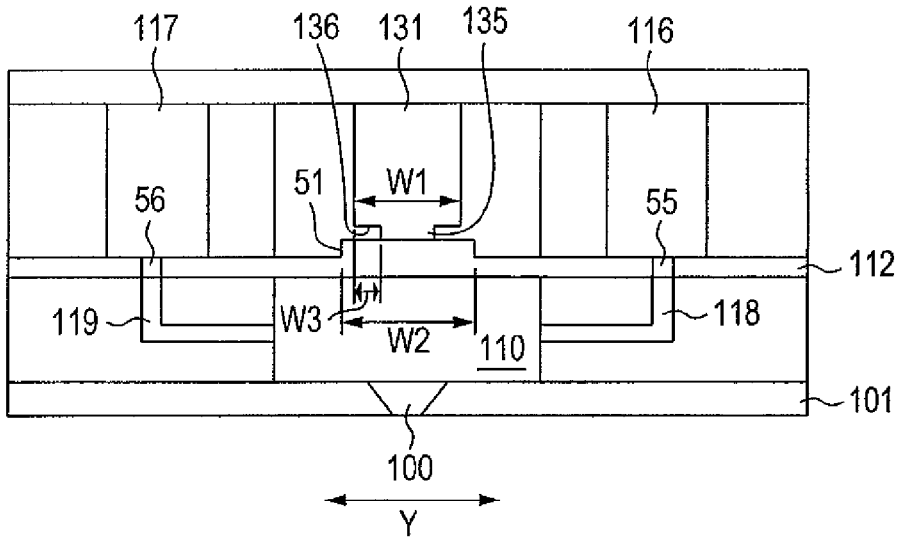

In the present embodiment, diaphragm 112 is provided with convex portions 51 and 52. Alternatively, diaphragm 112 may not be provided with convex portions 51 and 52, but piezoelectric elements 131 and 132 may be provided with convex portion 51 and piezoelectric elements 141, 142 and 143 may be provided with convex portion 52. For example, as shown in FIG. 10B, the piezoelectric element may further include convex portion 135 that is in contact with diaphragm 112 in direction Y. Convex portion 135 is formed by, for example, providing rectangular notches 136 at the opposite end edges of piezoelectric element 131 in direction Y. Each width W3 of notches 136 in direction Y is 50 to 100 μm, for example. The width of piezoelectric element 131 in FIG. 10B (L4 in FIG. 7A) is 100 to 200 μm, for example. Convex portion 135 is further hard to protrude in direction Y outwardly off convex portion 51. Therefore, it is effective to stably press diaphragm 112 arranged on pressure chamber 110 and partition wall 111. The piezoelectric element having convex portions can be formed by adjusting the width and depth of dicing (for example, first, dicing is performed on the piezoelectric element at a small width to a great depth and then at a large width to a small depth). Further, diaphragm 112, not partition wall 111, may be provided with convex portions 53.

Figure 11A:
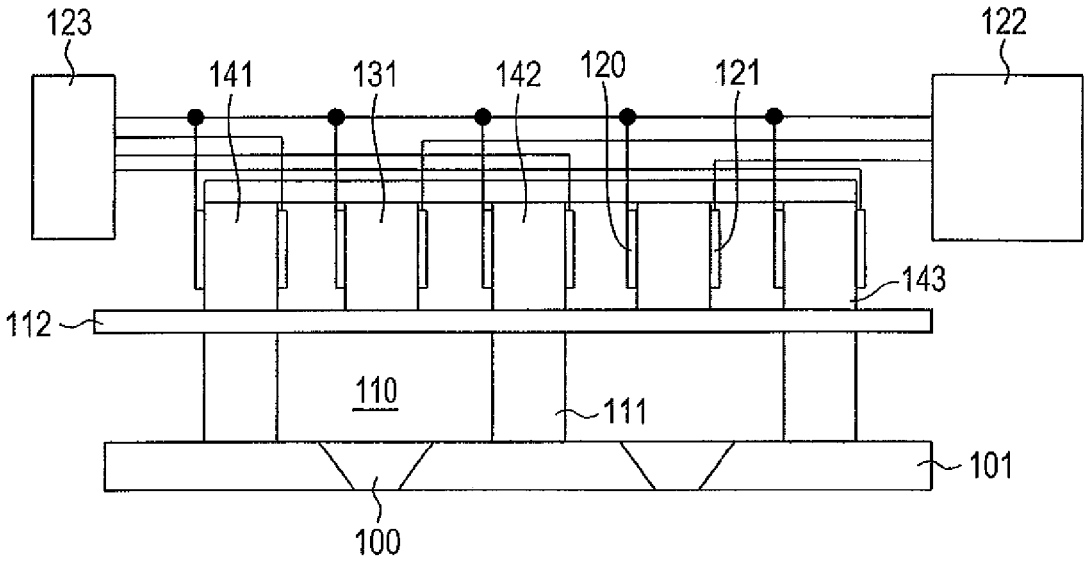
FIGS. 11A and 11B are a cross-sectional view of an ink-jet head according to Embodiment 1 of the present invention.
Figure 11B:
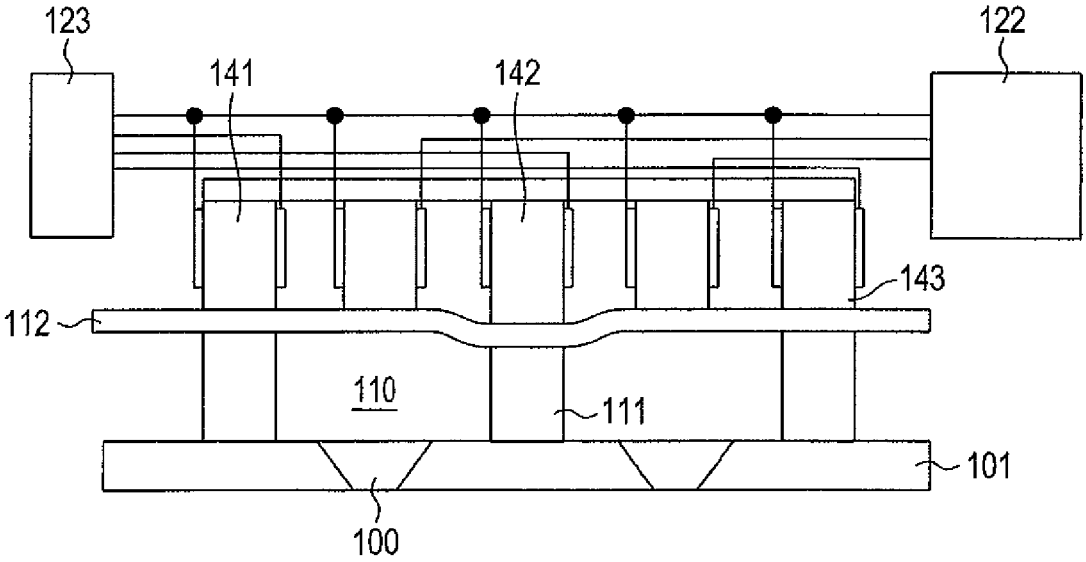

Next, correction of curved flying of ink droplets in the case where ink ejected from nozzle 100 corresponding to piezoelectric element 131 flies to the right of the drawing, will be described with reference to FIG. 11. FIG. 11A schematically shows an ink-jet head before the operation for correction of curved flying of ink droplets. FIG. 11B schematically shows an ink-jet head during the operation for correction of curved flying of ink droplets. In the following FIGS. 11 to 14, convex portions 51 to 53 are not illustrated.

Curved flying of ink droplets is generally detected by ejecting ink to a dummy panel or the like and performing image processing on the ink droplets that have been landed on the dummy panel or the like before ink is ejected to a panel, which is a product. Curved flying of ink droplets occurs due to, for example, degradation of liquid-repellent coating on the surface of nozzle 100.

When curved flying of ink droplets from nozzle 100 corresponding to piezoelectric element 131 to the right of the drawing has been detected, in the ink-jet head of the present embodiment, a voltage is applied from direction control circuit 123 to piezoelectric element 142 supporting partition wall 111 at the right side of that nozzle 100 to extend piezoelectric element 142. As a result, as shown in FIG. 11B, partition wall 111 is deformed by piezoelectric element 142. This deformation decreases the volume of pressure chamber 110 at the right side of the drawing.

Figure 1:
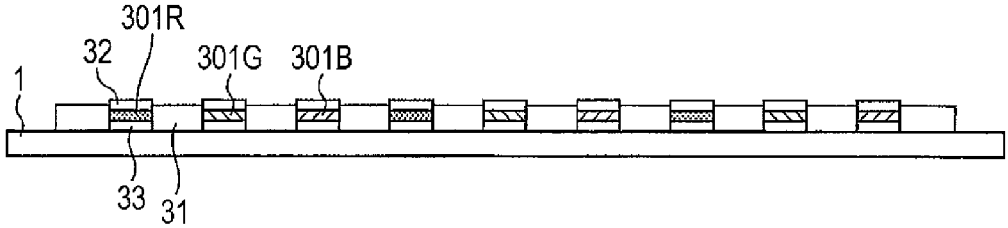
FIG. 1 is a cross-sectional view of an organic EL display panel.
Figure 2:
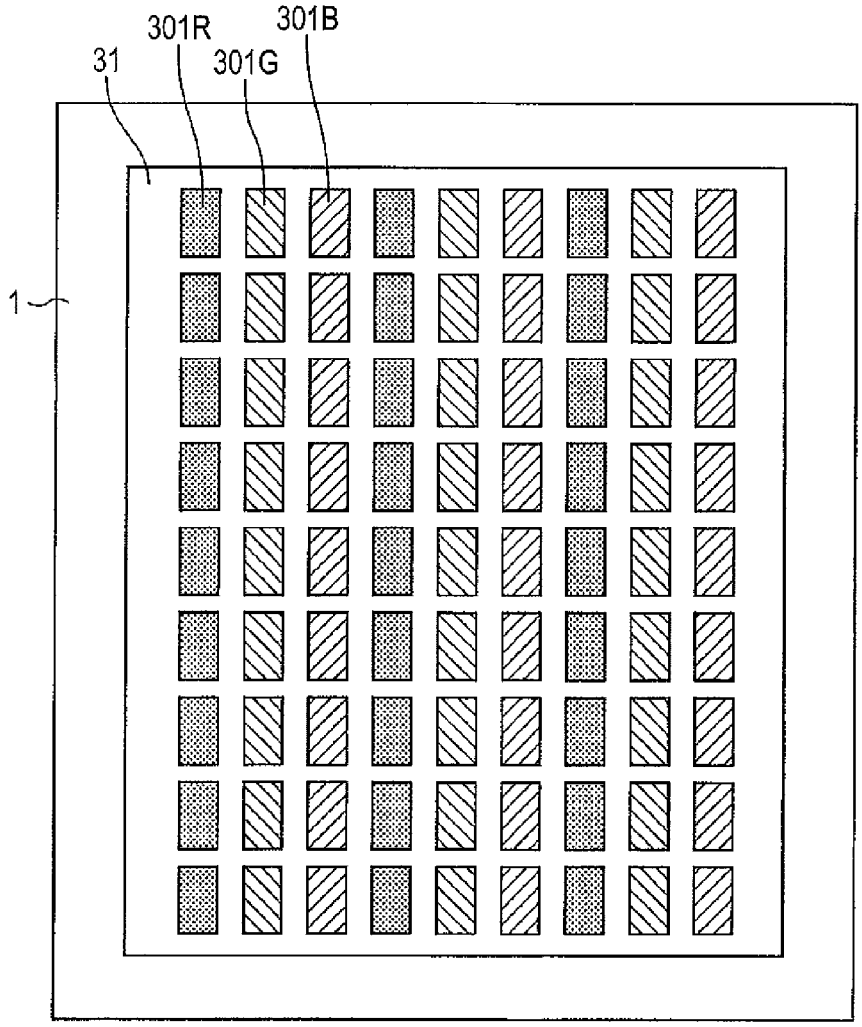
FIG. 2 is a plan view of an organic EL display panel.
Figure 3A:
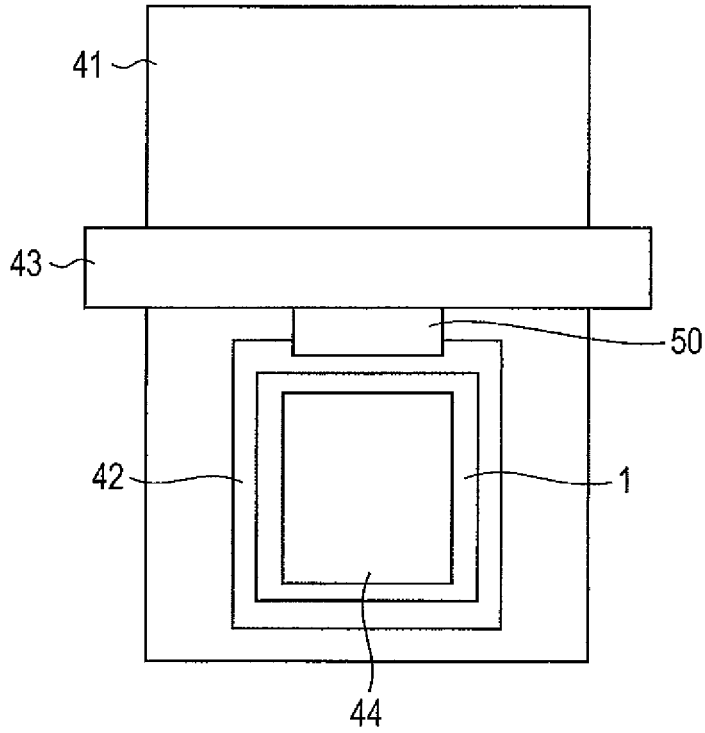
FIGS. 3A and 3B show an overview of an ink-jet apparatus.
Figure 3B:
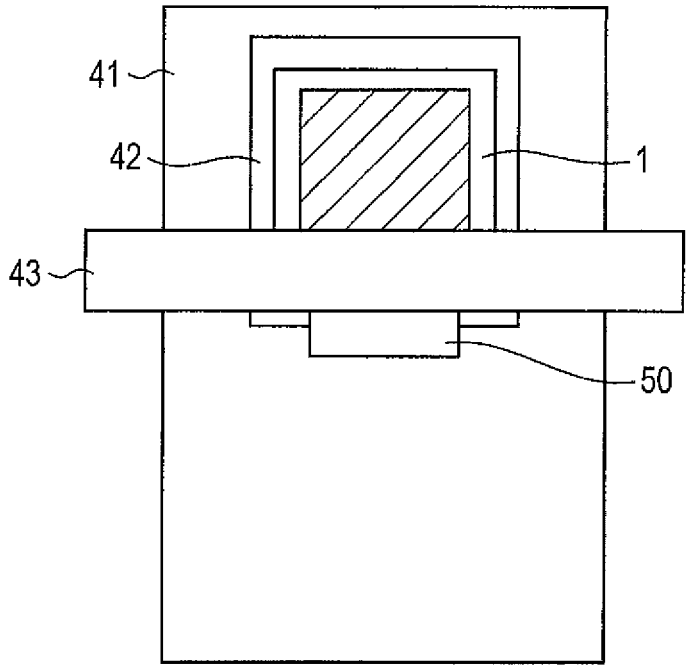
Figure 4A:
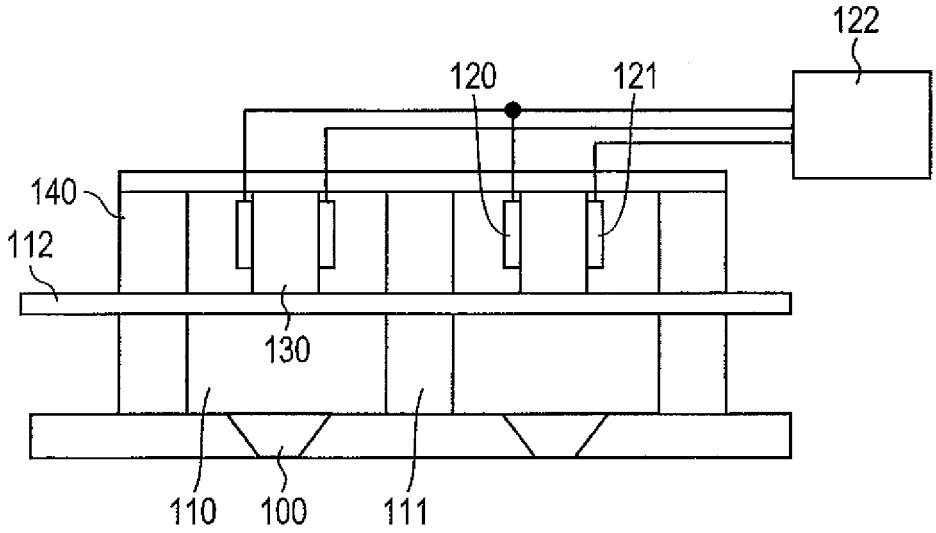
FIGS. 4A and 4B are a schematic drawing of a conventional ink-jet head.
Figure 4B:
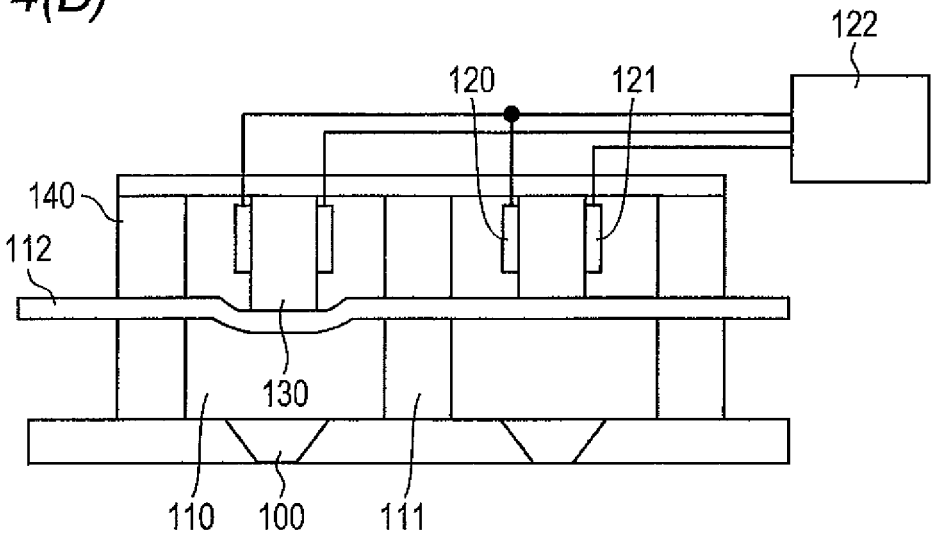
Figure 5:
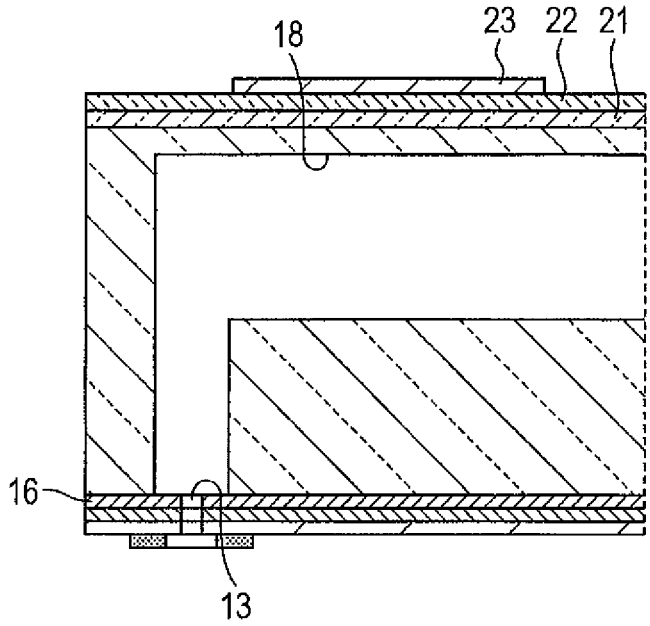
FIG. 5 shows an ink-jet head according to Patent Literature 1.

In this condition, a voltage is applied to piezoelectric element 131 from drive circuit 122 to extend piezoelectric element 131. Then, as shown in FIGS. 4A and 4B, the volume of pressure chamber 110 becomes smaller and the pressure in pressure chamber 110 increases. Because the volume of pressure chamber 110 is smaller in a right side space than in a left side space, the pressure of the ink in the right side space is higher than the pressure of the ink in the left side space. For this reason, by extension of piezoelectric element 131, a force is generated for correcting the flying direction of ink droplets to the left. As a result, curved flying of ink droplets to the right is corrected, allowing ink to be ejected without curved flying.

As described above, according to the present embodiment, the balance of the pressure in direction X for ejecting ink is changed by deforming the shape of pressure chamber 110. For this reason, compared to the ink-jet head of Patent Literature 1 or the like that controls only the direction of the tip of nozzle 100, the control range of the direction for ink ejection can be expanded. As a result, it is possible to reliably correct the variation in the direction for ink ejection.

Further, in the above embodiment, piezoelectric element 142 supporting one of the partition walls 111 constituting pressure chamber 110 is extended. However, in order to enhance the control of the curved flying of ink droplets to the right, it is more effective to contract piezoelectric element 141 that supports the other of the partition walls 111 constituting the pressure chamber 110 at the same time when piezoelectric element 142 is extended. It is preferable that a voltage be applied to piezoelectric elements 141 and 142 continuously. A voltage may be periodically applied to piezoelectric elements 131 and 132. However, periodically applying a voltage to piezoelectric elements 141, 142 and 143 may cause heating and degradation of piezoelectric element. Further, it is desirable that a voltage to be applied to piezoelectric elements 141, 142 and 143 be changed according to curved flying of ink droplets. That is, when ink droplets fly in a curved way to a great extent, a high voltage is applied to the piezoelectric element, and when ink droplets fly in a curved way to a small extent, a lower voltage is applied to piezoelectric elements 141, 142 and 143.

Further, in order only to further improve the yield of a product when an ink-jet apparatus is used for manufacture of electronic devices, an ink-jet head is configured so as to include a structure in which common electrode 120 and individual electrode 121 are arranged only on piezoelectric elements 131 and 132 as shown in FIG. 4A, and a structure including a particular width of a part of the piezoelectric element, the part being in contact with diaphragm 112, and a particular width of a part of diaphragm 112, the part being in contact with partition wall 111 as shown in FIGS. 7A and 7B. By this means, regardless of whether some displacement in direction X or direction Y occurs upon positioning diaphragm 112 and the piezoelectric element or upon positioning diaphragm 112 and partition wall 111, it is possible to obtain the ink-jet apparatus in which diaphragm 112 is stably deformed with respect to pressure chamber 110.

Embodiment 2

Figure 12A:
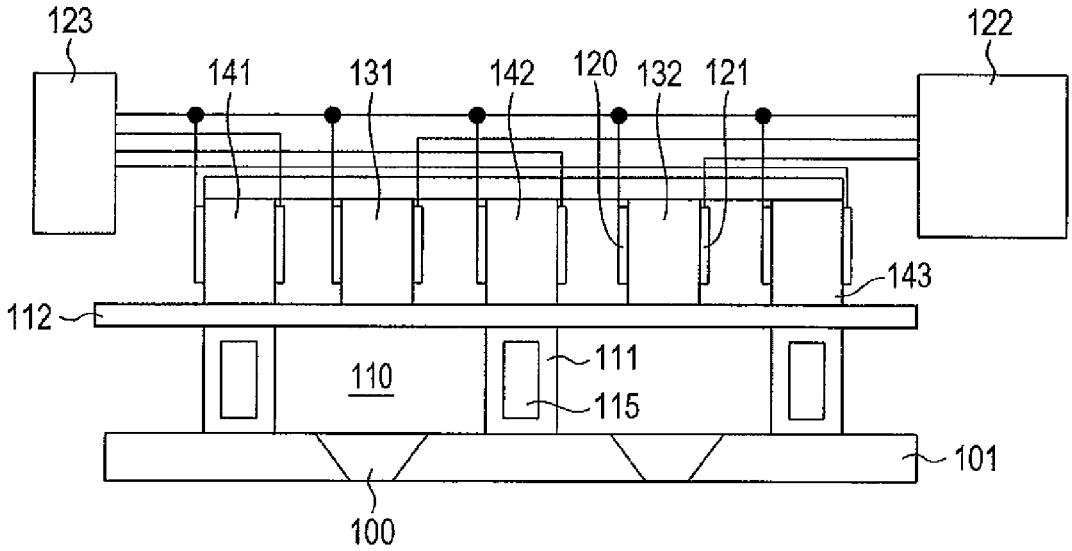
FIGS. 12A and 12B show an ink-jet head according to Embodiment 2 of the present invention.
Figure 12B:
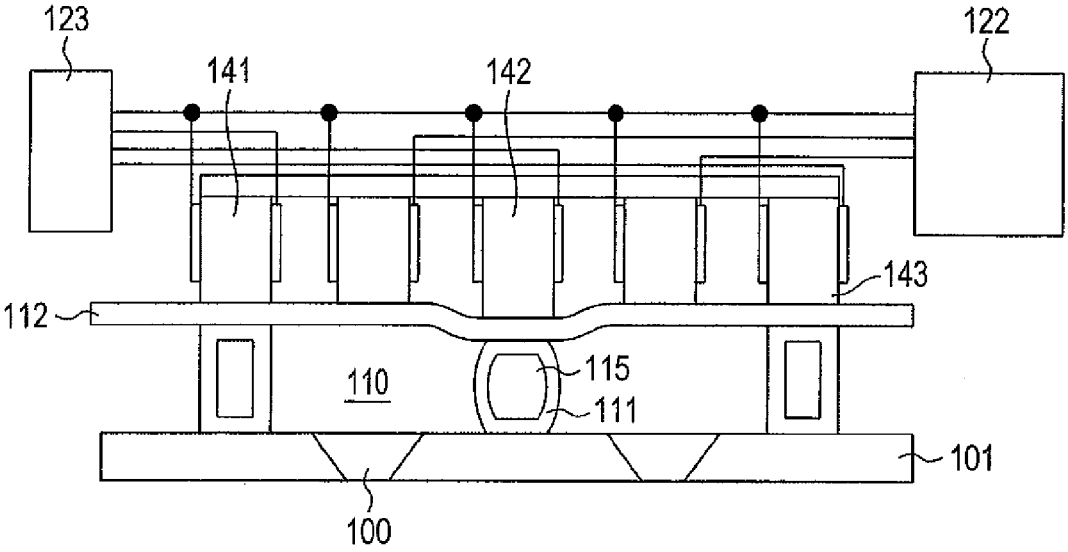

FIGS. 12A and 12B show an ink-jet head according to Embodiment 2 of the present invention. FIG. 12A schematically shows the ink-jet head according to the present embodiment before the operation for correction of curved flying of ink droplets. FIG. 12B schematically shows the ink-jet head according to the present embodiment during the operation for correction of curved flying of ink droplets. Parts in FIGS. 12A and 12B that are the same as in FIGS. 11A and 11B will be assigned the same reference signs as in FIGS. 11A and 11B, and overlapping explanations will not be provided.

In the ink-jet head according to the present embodiment, compared to the ink-jet head according to Embodiment 1, compressive stiffness (stiffness against compression) of partition wall 111 is set lower than those of other walls of pressure chamber 110. Specifically, partition wall 111 has cavity 115.

Figure 13A:
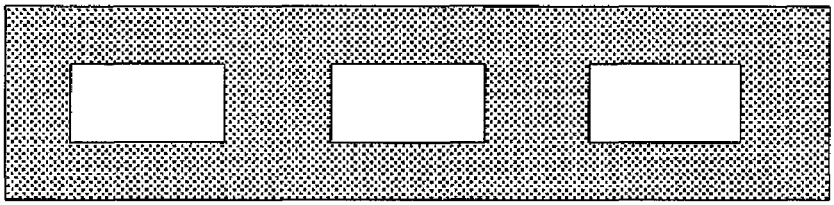
FIGS. 13A to 13C show a method of making partition wall 111 according to Embodiment 2 of the present invention.
Figure 13B:
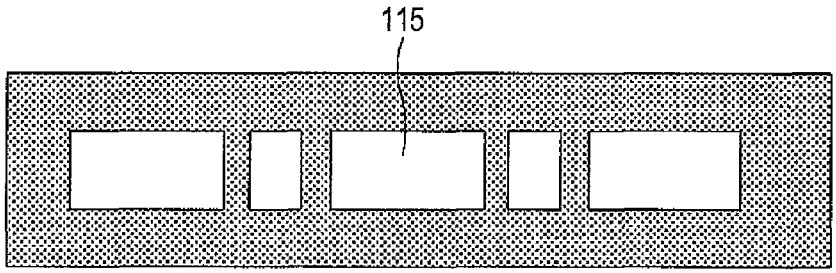
Figure 13C:
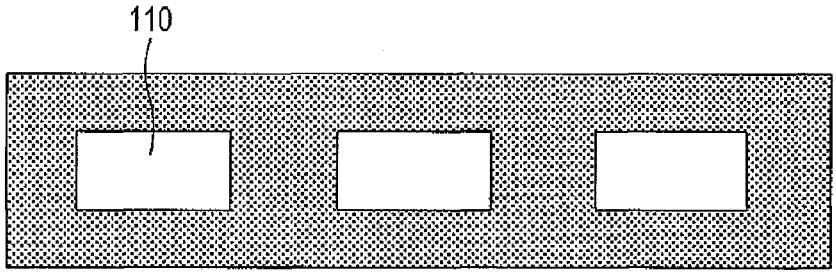

A method of making a partition wall 111 made of stainless steel that has cavity 115 will be described with reference to FIG. 13. FIGS. 13A to 13C show the members constituting partition wall 111, seen along the axial direction of nozzle 100 of FIGS. 12A and 12B. Each part is generally made of metal such as SUS. Partition wall 111 having cavity 115 shown in FIGS. 12A and 12B can be made by stacking three thin plates made of stainless steel shown in FIGS. 13A to 13C, for example, in order of A, B and C from the top, and then thermal-diffusion-bonding the stacked thin plates.

When curved flying of ink droplets from nozzle 100 corresponding to piezoelectric element 131 to the right of the drawing is detected, as with Embodiment 1, curved flying of ink droplets to the right is corrected by extending piezoelectric element 142 supporting partition wall 111 at the right side of that nozzle 100 to deform partition wall 111 corresponding to piezoelectric element 142 as shown in FIG. 12B. In this way, as with Embodiment 1, the variation in the direction for ink ejection is corrected.

According to the present embodiment, because partition wall 111 has cavity 115 inside, the shape of pressure chamber 110 can be deformed further efficiently. That is, when a constant voltage is applied to piezoelectric element 142, change in the volume of pressure chamber 110 in the present embodiment is greater than the change in the volume of pressure chamber 110 in Embodiment 1. Therefore, the variation in the direction for ink ejection can be corrected more reliably.

Embodiment 3

Figure 14A:
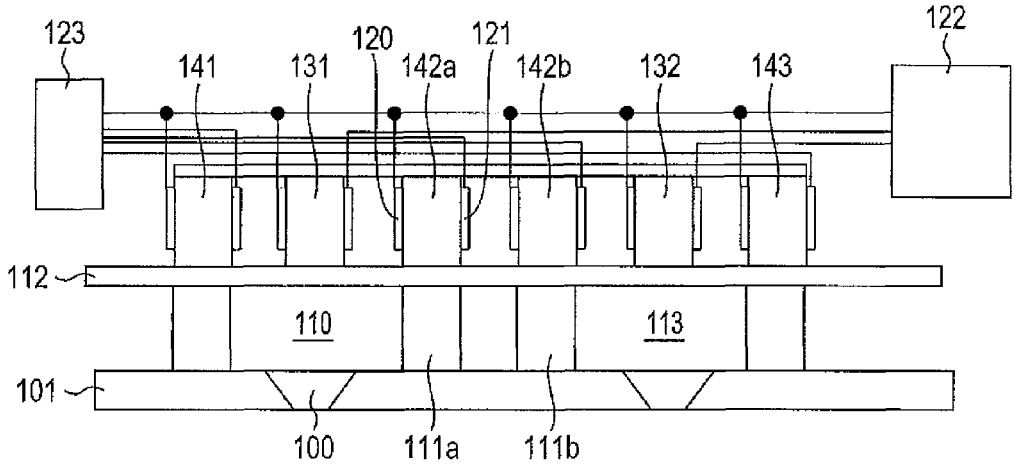
FIGS. 14A and 14B show an ink-jet head according to Embodiment 3 of the present invention.
Figure 14B:
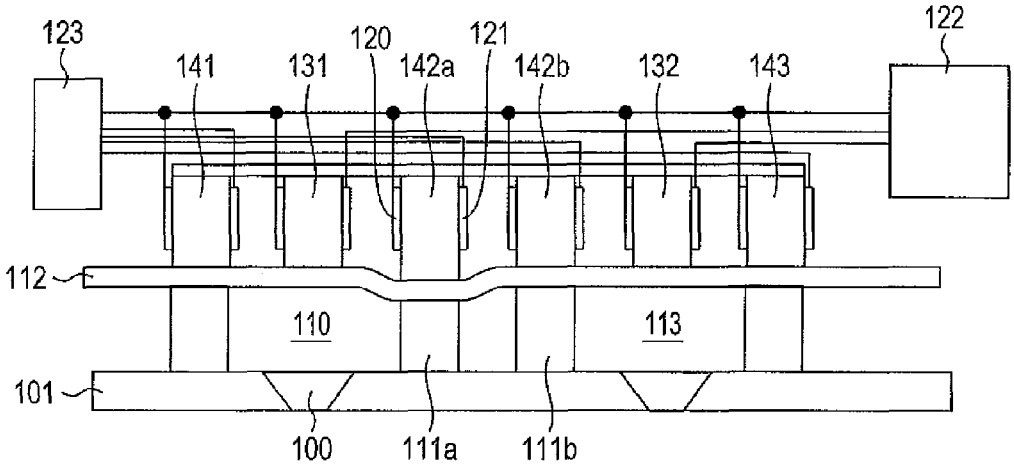

FIGS. 14A and 14B show an ink-jet head according to Embodiment 3 of the present invention. Parts in FIGS. 14A and 14B that are the same as in FIGS. 11A and 11B will be assigned the same reference signs as in FIGS. 11A and 11B, and overlapping explanations will not be provided. FIG. 14A schematically shows an ink-jet head according to the present embodiment before the operation for correction of curved flying of ink droplets. FIG. 14B schematically shows an ink-jet head during the operation for correction of curved flying of ink droplets.

The ink-jet head according to the present embodiment is different from the ink-jet head according to Embodiment 1 in that two partition walls 111*a* and 111*b* are arranged between pressure chamber 110 and pressure chamber 113 that is adjacent to pressure chamber 110, and that piezoelectric element 142*a* supporting partition wall 111*a* and piezoelectric element 142*b* supporting partition wall 111*b* are arranged.

When curved flying of ink droplets from nozzle 100 corresponding to piezoelectric element 131 to the right of the drawing is detected, as with Embodiment 1, curved flying of ink droplets to the right is corrected by extending piezoelectric element 142*a* supporting partition wall 111*a* at the right side of nozzle 100 to deform partition wall 111*a* corresponding to piezoelectric element 142*a* as shown in FIG. 14B. By this means, as with Embodiment 1, the variation in the direction for ink discharge is corrected.

According to the present embodiment, two partition walls 111*a* and 111*b* are arranged between pressure chambers 110 and 113. For this reason, even when partition wall 111*a* is deformed, the shape of pressure chamber 113 that is adjacent to partition wall 111*a* is not deformed concurrently. Therefore, even when one nozzle 100 and another nozzle 100 adjacent to the one nozzle 100 eject ink at the same time, the variation in the direction for ink ejection from the one nozzle 100 can be reliably corrected without adversely affecting ink ejection from the another nozzle 100. For this reason, it is possible to prevent crosstalk that can be caused by this correction. The invention according to the present embodiment is suitable for an ink-jet head for ejecting ink from one nozzle 100 and another nozzle 100 adjacent to the one nozzle 100 at the same time. Further, in Embodiments 1 and 2, compared to the present embodiment, the pitch of nozzle 100 can be reduced. For this reason, in Embodiments 1 and 2, compared to Embodiment 3, ink can be landed on a panel with higher density. The inventions according to Embodiments 1 and 2 are suitable for an ink-jet head for applying ink uniformly.

INDUSTRIAL APPLICABILITY

The present invention is applicable to an ink-jet apparatus used for formation of a light emitting layer of an organic EL by coating and for application of color materials for color filters.

REFERENCE SIGNS LIST

1 substrate
13, 100 nozzle
16 thin plate material
18 vibration plate
21, 23 electrode
22, 130, 131, 132, 140, 141, 142, 142*a*, 142*b*, 143, 144 piezoelectric element
31 bank (partition wall)
32 cathode
33 anode
41 mount
42 substrate transfer stage
43 gantry
44 region
50 ink-jet head
51 to 53, 135 convex portion
55, 56 hole
101 nozzle plate

110, 113 pressure chamber
111, 111*a*, 111*b* partition wall
112, 172 diaphragm
115 cavity
116 ink supply channel
117 ink discharge channel
118 ink inlet channel
119 ink outlet channel
120 common electrode
121 individual electrode
122 drive circuit
123 direction control circuit
134 tapered surface
136 notch
173 thin part
301R, 301G, 301B light emitting layer

The invention claimed is:

1. An ink jet apparatus comprising:

multiple nozzles for ejecting ink;

pressure chambers, each of the pressure chambers communicating with each of the nozzles;

piezoelectric elements A for applying a pressure to the pressure chambers;

partition walls arranged between the pressure chambers;

piezoelectric elements B, each of piezoelectric elements B supporting each of the partition walls; and a diaphragm arranged between the partition walls and the piezoelectric elements B, the diaphragm being in contact with the piezoelectric elements A; wherein:

a relationship L4≥L2>L1 is satisfied when: L1 is a width of a first convex part of the diaphragm in direction X along which the nozzles are arranged, the first convex part being in contact with one of the piezoelectric elements A; L2 is a width of a second convex part of the diaphragm in direction X, the second convex part being in contact with one of the piezoelectric elements B; and L4 is a width of a part of each of the piezoelectric elements A and the piezoelectric elements B in direction X; and a relationship W2>W1 is satisfied when: W1 is a width of a part of each of the piezoelectric elements A and the piezoelectric elements B in direction Y perpendicular to direction X and along an axis of each of the nozzles; and W2 is a width of the first convex part of the diaphragm in direction Y.

2. The ink jet apparatus according to claim 1, further comprising:

an ink supply channel configured to allow ink to be supplied to the pressure chambers to flow therein and an ink discharge channel configured to allow ink discharged from the pressure chambers to flow therein, the ink supply channel and the ink discharge channel being arranged at the piezoelectric element side with respect to the diaphragm;

ink inlet channels configured to allow the ink supply channel to communicate with the pressure chambers via through holes X formed in the diaphragm, the ink inlet channels being arranged at the partition wall side with respect to the diaphragm; and ink outlet channels configured to allow each of the pressure chambers to communicate with the ink discharge channel via through holes Y formed in the diaphragm, the ink outlet channels being arranged at the partition wall side with respect to the diaphragm.

3. The ink jet apparatus according to claim 1, wherein a relationship L2>L3 is satisfied when L3 is a width of a part of each of the partition walls in direction X, the part being in contact with the diaphragm.

4. The ink jet apparatus according to claim 2, wherein each of through holes X is a mesh in the diaphragm.

5. The ink-jet apparatus according to claim 1, wherein compressive stiffness of the partition walls is lower than compressive stiffness of other walls of each of the pressure chambers.

6. The ink-jet apparatus according to claim 1, wherein at least two of the partition walls are arranged between the pressure chambers, and at least two of the piezoelectric elements B respectively support each of the partition walls.

* * * * *